US008486219B2

(12) United States Patent
Wu et al.

(10) Patent No.: US 8,486,219 B2
(45) Date of Patent: Jul. 16, 2013

(54) PAPER LAMINATES HAVING IMPROVED EASY CLEAN AND ABRASION RESISTANCE PROPERTIES

(75) Inventors: Dan Qing Wu, West Chester, PA (US); Jessica Chen-Ying Yen, Greenville, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 297 days.

(21) Appl. No.: 12/992,920

(22) PCT Filed: Jun. 17, 2009

(86) PCT No.: PCT/US2009/047641

§ 371 (c)(1), (2), (4) Date: Nov. 16, 2010

(87) PCT Pub. No.: WO2009/158251

PCT Pub. Date: Dec. 30, 2009

(65) Prior Publication Data

US 2011/0061785 A1 Mar. 17, 2011

Related U.S. Application Data

(60) Provisional application No. 61/075,853, filed on Jun. 26, 2008.

(51) Int. Cl.

| | |
|---|---|
| ***B29C 65/00*** | (2006.01) |
| ***B31B 1/60*** | (2006.01) |
| ***B32B 37/00*** | (2006.01) |
| ***C09J 4/00*** | (2006.01) |
| ***C09J 101/00*** | (2006.01) |
| ***C09J 201/00*** | (2006.01) |

(52) U.S. Cl.
USPC ..... 156/331.7; 156/60

(58) Field of Classification Search
USPC ..... 156/60, 331.7
See application file for complete search history.

(56) References Cited

U.S. PATENT DOCUMENTS

| | | | | |
|---|---|---|---|---|
| 3,124,605 | A | 3/1964 | Wagner et al. | |
| 4,713,138 | A | 12/1987 | Ungar et al. | |
| 4,880,689 | A | 11/1989 | Park et al. | |
| 5,545,476 | A | 8/1996 | O'Dell et al. | |
| 5,609,966 | A | 3/1997 | Perrin et al. | |
| 5,672,651 | A | 9/1997 | Smith | |
| 5,827,919 | A * | 10/1998 | May | 524/590 |
| 6,287,681 | B1 * | 9/2001 | Mehta et al. | 428/323 |
| 6,517,674 | B1 * | 2/2003 | Das | 162/135 |
| 6,881,782 | B2 | 4/2005 | Crater et al. | |
| 2003/0105263 | A1 | 6/2003 | Fan et al. | |
| 2005/0075471 | A1 | 4/2005 | Fan et al. | |
| 2006/0062923 | A1 | 3/2006 | Dilley et al. | |
| 2009/0240004 | A1 | 9/2009 | Maier et al. | |

FOREIGN PATENT DOCUMENTS

| | | |
|---|---|---|
| DE | 102006046368 | 4/2008 |
| EP | 0218909 | 4/1987 |
| GB | 1422554 | 1/1976 |
| WO | WO93/17165 | 9/1993 |
| WO | WO96/12059 | 4/1996 |
| WO | WO97/12923 | 4/1997 |
| WO | WO2004/065467 | 8/2004 |
| WO | WO2007/085416 | 8/2007 |

OTHER PUBLICATIONS

International Search Report, Nov. 3, 2009.

* cited by examiner

*Primary Examiner* — Michael Orlando

(57) ABSTRACT

The present disclosure pertains to a process for preparing a laminate comprising: providing a dried overlay and a base sheet wherein at least one of the dried overlay and the base sheet comprises a resin-impregnated, opaque, cellulose pulp-based sheet; applying a fluorourethane to the dried overlay to form a treated overlay; drying the treated overlay; and laminating the treated overlay to the base sheet. The disclosed process hereby produces a laminate whose outer surface is modified with the fluorourethane and the cleanability, oil repellency, and abrasion resistance of such a laminate is improved.

10 Claims, No Drawings

PAPER LAMINATES HAVING IMPROVED EASY CLEAN AND ABRASION RESISTANCE PROPERTIES

CROSS-REFERENCE TO RELATED APPLICATIONS

This application claims the benefit of U.S. Provisional Application No. 61/075,853 filed Jun. 26, 2008, incorporated by reference herein in its entirety.

BACKGROUND OF THE DISCLOSURE

The present disclosure pertains to paper laminates and more particularly to paper laminates useful as floor surfacing materials. In particular, the disclosure relates to fluorourethane treated dried overlays of laminate surfaces which have improved cleanability, oil resistance and abrasion resistance.

Paper laminates are in general well-known in the art, being suitable for a variety of uses including table and desk tops, countertops, wall panels, floor surfacing, tableware and the like. Paper laminates have such a wide variety of uses because they can be made to be extremely durable, and can be also made to resemble (both in appearance and texture) a wide variety of construction materials, including wood, stone, marble and tile, and can be decorated to carry images and colors.

Typically, the paper laminates are made from papers by impregnating the papers with resins of various kinds, assembling several layers of one or more types of laminate papers, and consolidating the assembly into a unitary core structure while converting the resin to a cured state. The type of resin and laminate paper used, and composition of the final assembly, are generally dictated by the end use of the laminate.

Decorative paper laminates can be made by utilizing a printed decorative paper layer as upper paper layer and various support paper layers in the unitary core structure. The decorative paper is typically highly opaque so that the appearance of the support layers below the decorative paper does not adversely impact the appearance of the decorative paper laminate. A decorative paper is also known as a décor paper.

To achieve required abrasion, scuff, and mar resistance, typically, a separate overlay is used as the top layer for paper laminates. An overlay usually comprises the same resin as the one that is used for the resin impregnated decorative paper.

A laminate has been made by applying to the outer layer of a composite structure a mixture of an additive amount of a fluorourethane additive, available from E. I. du Pont de Nemours and Company and a melamine resin slurry. Paper laminates may be produced by both low- and high-pressure lamination processes.

Various methods can be employed to provide paper laminates by low-pressure lamination. For example, a single opening, quick cycle press can be used where one or more resin-saturated paper sheets are laminated to a sheet of plywood typically with a 1A face, particle board, or fiberboard.

In a high-pressure lamination process, a melamine overlay and a melamine resin-impregnated décor paper are usually laminated onto a phenolic sheet, which provides additional mechanical support. For example, a "continuous laminator" can be used where one or more layers of the resin-saturated paper are pressed into a unitary structure as the layers move through continuous laminating equipment between plates, rollers or belts. One or two laminated sheets (continuous web or cut to size) may be pressed onto a particle or fiberboard, etc. and a "glue line" used to bond the laminated sheet to the board. Single or multiple opening presses may also be employed which contain several laminates.

The decor paper in such paper laminates generally comprises a resin-impregnated, cellulose pulp-based sheet, with the pulp being based predominantly on hardwoods such as eucalyptus, sometimes in combination with minor amounts of softwood pulps. Pigments (such as titanium dioxide) and fillers are added in amounts generally up to and including about 45 wt % (based on the total dry weight prior to resin impregnation) to obtain the required opacity. Other additives such as wet-strength, retention, sizing (internal and surface) and fixing agents may also be added as required to achieve the desired end properties of the paper. The resin can be a thermosetting resin selected from the group consisting of a polymer of diallyl phthalate, epoxide, urea formaldehyde, urea-acrylic acid ester copolyester, melamine formaldehyde, melamine phenol formaldehyde, dicyandiamide-formaldehyde, urethane, curable acrylic, unsaturated polyester and phenol formaldehyde and mixtures thereof.

A need exists for such laminates, produced by a low or high pressure lamination process, to impart easy clean characteristics to the decorative surface portion of the laminate to enhance the utility of such laminates in end-use applications such as table and countertops, wall panels and floors.

SUMMARY OF THE DISCLOSURE

The disclosure relates to a process for preparing a laminate, comprising:

(a) providing a dried overlay and a base sheet wherein at least one of the dried overlay and the base sheet comprises a resin-impregnated, opaque, cellulose pulp-based sheet;

(b) applying a surface treatment to the dried overlay to form a treated overlay, wherein the surface treatment consists essentially of a fluorourethane reaction product of (1) at least one diisocyanate, polyisocyanate, or mixture of polyisocyanates having at least three isocyanate groups per molecule, (2) at least one fluorochemical compound having at least one Zerewitinoff hydrogen in an amount sufficient to react with 5% to 80% of the isocyanate groups in the diisocyanate or polyisocyanate, (3) at least one compound of the formula $R_{10}$—$(R_2)_k$—YH in an amount sufficient to react with 5% to 80% of the isocyanate groups in the diisocyanate or polyisocyanate and wherein $R_{10}$ is a $C_1$-$C_{18}$ alkyl, $C_1$-$C_{18}$ omega-alkenyl radical, or $C_1$-$C_{18}$ omega-alkenoyl; $R_2$ is —$C_nH_{2n}$— optionally end-capped by —$[OCH_2C(R_4)H]_p$—, —$OCH_2C(CH_2Cl)H]_p$—, or —$C(R_5)(R_6)(OCH_2C[CH_2Cl]H)_p$— wherein $R_4$, $R_5$, and $R_6$ are the same or different and are H or a $C_1$-$C_6$ alkyl radical, n is 0 to 12, p is 1 to 50; Y is O, S, or $N(R_7)$ wherein $R_7$ is H or $C_1$-$C_6$ alkyl; and k is 0 or 1, and (4) water in an amount sufficient to react with 5% to 60% of the isocyanate groups in the diisocyanate or polyisocyanate;

(c) drying the treated overlay from step (b); and (d) laminating the dried treated overlay from step (c) to the base sheet.

The dried overlay can comprise a resin-impregnated, opaque, cellulose pulp-based sheet. The resin can be a thermosetting resin selected from the group consisting of a polymer of diallyl phthalate, epoxide, urea formaldehyde, urea-acrylic acid ester copolyester, melamine formaldehyde, melamine phenol formaldehyde, dicyandiamide-formaldehyde, urethane, curable acrylic, unsaturated polyester and phenol formaldehyde and mixtures thereof. The dried overlay can further comprise a binding material selected from the group consisting of microcrystalline cellulose, carboxyl methyl cellulose, sodium alginate and mixtures thereof. Still further, the dried overlay can further comprise mineral particles selected from the group consisting of aluminum oxide, silicon oxide and mixtures thereof.

The base sheet can comprise a resin-impregnated, opaque, cellulose pulp-based sheet. The resin can be a thermosetting resin selected from the group consisting of a polymer of diallyl phthalate, epoxide, urea formaldehyde, urea-acrylic acid ester copolyester, melamine formaldehyde, melamine phenol formaldehyde, dicyandiamide-formaldehyde, urethane, curable acrylic, unsaturated polyester and phenol formaldehyde and mixtures thereof.

In one embodiment, when the dried overlay comprises a resin, and the base sheet is a resin-impregnated, opaque, cellulose pulp-based sheet, the resin of the base sheet and the resin of the dried overlay are the same.

The dried overlay can be made by forming a water-dispersed overlay comprising a suspension of a resin and a binding material in an aqueous medium and drying the suspension by removing water from the suspension to form the dried overlay.

In one embodiment, the surface treatment can be substantially free of a thermosetting resin, more specifically, free of a thermosetting resin. The thermosetting resin can be selected from the group consisting of a polymer of diallyl phthalate, epoxide, urea formaldehyde, urea-acrylic acid ester copolyester, melamine formaldehyde, melamine phenol formaldehyde, dicyandiamide-formaldehyde, urethane, curable acrylic, unsaturated polyester and phenol formaldehyde and mixtures thereof. When the surface treatment is substantially free of a thermosetting resin only a minor additive amount of the thermosetting resin, typically from 0.0005 wt. % to about 10 wt %, based on the entire weight of the surface treatment, can be present. To minimize or, preferably, eliminate haze, to permit the prints of the décor paper to show through the overlay, when a minor additive amount of a thermosetting resin is mixed in with the fluorourethane reaction product, the thermosetting resin is preferably either the same as the resin of the dried overlay or, if different, the resin has a similar or, preferably, identical refractive index.

Alternatively, the surface treatment can be free of a thermosetting resin.

The disclosure additionally relates to a method for improving the cleanability of a laminate surface or the oil repellency of a laminate surface, comprising:

(a) providing a dried overlay and a base sheet wherein at least one of the dried overlay and the base sheet comprises a resin-impregnated, opaque, cellulose pulp-based sheet;

(b) applying a surface treatment to the dried overlay to form a treated overlay, wherein the surface treatment consists essentially of a fluorourethane reaction product of (1) at least one diisocyanate, polyisocyanate, or mixture of polyisocyanates having at least three isocyanate groups per molecule, (2) at least one fluorochemical compound having at least one Zerewitinoff hydrogen in an amount sufficient to react with 5% to 80% of the isocyanate groups in the diisocyanate or polyisocyanate, (3) at least one compound of the formula $R_{10}$—$(R_2)_k$—YH in an amount sufficient to react with 5% to 80% of the isocyanate groups in the diisocyanate or polyisocyanate and wherein $R_{10}$ is a $C_1$-$C_{18}$ alkyl, $C_1$-$C_{18}$ omega-alkenyl radical, or $C_1$-$C_{18}$ omega-alkenoyl; $R_2$ is —$C_nH_{2n}$— optionally end-capped by —$[OCH_2C(R_4)H]_p$—, —$[OCH_2C(CH_2Cl)H]_p$—, or —$C(R_5)(R_6)(OCH_2C[CH_2Cl]H)_p$— wherein $R_4$, $R_5$, and $R_6$ are the same or different and are H or a $C_1$-$C_6$ alkyl radical, n is 0 to 12, p is 1 to 50; Y is O, S, or $N(R_7)$ wherein $R_7$ is H or $C_1$-$C_6$ alkyl; and k is 0 or 1, and (4) water in an amount sufficient to react with 5% to 60% of the isocyanate groups in the diisocyanate or polyisocyanate;

(c) drying the treated overlay from step (b); and (d) laminating the dried treated overlay from step (c) to the base sheet.

In one embodiment, the fluorochemical compound is perfluoroalkyl in an amount sufficient to react with at least 40% of the isocyanate groups and wherein the compound of the formula $R_{10}$—$(R_2)_k$—YH is polyethylene glycol methyl ether in an amount sufficient to react with at least 30% of the isocyanate groups.

In the laminate of this disclosure the fluorourethane composition is applied to a dried overlay which provides a high concentration of the fluorourethane at the outer surface of the laminate for improved cleanability and oil repellency.

In another embodiment, the disclosure relates to a method for improving abrasion resistance of a laminate surface, comprising: providing a dried overlay and a base sheet wherein at least one of the dried overlay and the base sheet comprises a resin-impregnated, opaque, cellulose pulp-based sheet and the fluorourethane surface treatment is applied to the dried overlay to form a treated overlay that is abrasion resistant.

Applicants specifically incorporate the entire content of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the disclosure be limited to the specific values recited when defining a range. It is to be appreciated that certain features of the disclosure which are, for clarity, described above and below in the context of separate embodiments, may also be provided separately or in any subcombination. In addition, references in the singular may also include the plural (for example, "a" and "an" may refer to one, or more) unless the context specifically states otherwise. In one embodiment, the disclosure herein can be construed as excluding any element or process step that does not materially affect the basic and novel characteristics of the composition or process. Additionally, the disclosure can be construed as excluding any element or process step not specified herein.

DETAILED DESCRIPTION OF THE PREFERRED EMBODIMENTS

The disclosure provides an easy to clean laminate comprising a fluorourethane treated dried overlay and a base sheet wherein at least one of the dried overlay and the base sheet can comprise a resin-impregnated, opaque, cellulose pulp-based sheet. The base sheet can comprise a phenolic core or engineered wood comprising substrate such as particle or fiber board. The fluorourethane treated dried overlay and the base sheet can be laminated together utilizing a low pressure or a high pressure lamination process. The cleanability can be determined by measuring the percent stain retention using the Lenata oil stain cleanability test described hereinbelow. The cleanability can also be determined by the durable cleanability test and measuring contact angle. The Durable cleanability test and contact angle measurement procedure are described hereinbelow.

The disclosure additionally provides an abrasion resistant laminate. Abrasion resistance can be determined by the dual Taber® Abrader test to determine the percent gloss reduction as an indicator of abrasion resistance. The dual Taber® Abrader test procedure is also described hereinbelow.

Resin-Impregnated, Opaque, Cellulose Pulp-Based Sheet:

The resin-impregnated, opaque, cellulose pulp-based sheet is also known in the industry as Décor paper. The cellulose pulp used in the pulp-based sheet comprises pulp predominantly from hardwoods such as eucalyptus, sometimes in combination with minor amounts of softwood pulps. Pigments (such as titanium dioxide, more typically amino organosilane surface-modified titanium dioxide) and fillers can be added in amounts generally up to and including about 40 wt %, more typically about 20% to about 40%, (based on the total dry weight prior to resin impregnation) to obtain the required opacity. Other additives such as wet-strength, retention, sizing (internal and surface) and fixing agents may also be added as required to achieve the desired end properties of the Décor paper. Resins used to impregnate the papers are typically thermosetting resins. Examples of suitable thermosetting resins include, without limit, polymers of diallyl phthalate, epoxide, urea formaldehyde, urea-acrylic acid ester copolyester, melamine formaldehyde, melamine phenol formaldehyde, dicyandiamide-formaldehyde, urethane, unsaturated polyester, curable acrylic and phenol formaldehyde and mixtures thereof. In some situations, the resin used to impregnate this decorative sheet may contain abrasive inorganic particles selected from the group consisting of aluminum oxide or silicon oxide and mixtures thereof.

This resin impregnated, opaque, cellulose pulp-based sheet may contain a print, pattern design or solid color and these are generated using known techniques. Some such techniques include various well-known analog and digital printing methods to impart desired coloration and designs as required for the particular end use. Analog printing methods such as screen printing are particularly suitable for large runs and repetitive patterns. Digital printing methods such as inkjet printing are particularly suitable for short runs and customized patterning.

Some suitable resin-impregnated, opaque, cellulose pulp-based sheets are available from Mead Westvaco (11013 West Broad Street, Glen Allen, Va. 23060), as, solid colored Duoply® papers or printbase Primebase® papers.

Dried Overlay

The dried overlay can be wear resistant and the dried overlay can be used in both low pressure and high pressure lamination processes to provide improved resistance to abrasive wear. The dried overlay can be of varying thickness and can be low opacity, more typically substantially optically transparent.

The dried overlay can comprise a thermosetting resin or can be a resin-impregnated, opaque, cellulose pulp-based sheet as described above. The thermosetting resin used in the dried overlay can be subjected to a pre-cure step prior to the lamination process which also includes a curing step. The term "pre-cure" is used to mean that the cure of the resin particles has been advanced either to the maximum degree possible or at least to a stage of cure where the melt viscosity of the cured resin particles is sufficiently high to prevent these particles from melting and flowing under usual laminating conditions and thus undesirably saturating into the décor paper or other resin-impregnated, opaque, cellulose pulp-based sheet, during the lamination step to form the laminate.

The resins are typically thermosetting resins. Examples of suitable thermosetting resins include, without limit polymer of diallyl phthalate, epoxide, urea formaldehyde, urea-acrylic acid ester copolyester, melamine formaldehyde, melamine phenol formaldehyde, dicyandiamide-formaldehyde, urethane, curable acrylic, unsaturated polyester and phenol formaldehyde and mixtures thereof. More typically the resin used in the dried overlay is a formaldehyde-melamine polymer.

Especially when the dried overlay is not a resin impregnated, opaque, cellulose pulp-based sheet, the resin used to impregnate the resin-impregnated opaque cellulose pulp-based sheet typically has the same or substantially the same index of refraction as the resin in the dried overlay. More typically, the resin used in the dried overlay is the same resin used to impregnate the resin-impregnated opaque cellulose pulp-based sheet.

The dried overlay further comprises a binding material, selected from a group consisting of microcrystalline cellulose, carboxyl methyl cellulose, sodium alginate and mixtures thereof.

Optionally, the dried overlay further comprises mineral particles, usually ranging is size from about 20 to about 35 μm, comprising aluminum oxide, silicon oxide, or the mixture thereof, to further improve abrasion resistance.

The dried overlay can be transparent after curing.

The dried overlay can be made by processes well known in the paper making industry, by forming a suspension of the resin and the binding material together and drying the suspension to form the dried overlay. Optionally additional ingredients can be employed such as the mineral particles and opacifier, if the dried overlay is to be opaque.

The dried overlay can also be made by applying a thick layer of pre-cured thermosetting resin particles to the decorative sheet, as disclosed in U.S. Pat. No. 5,545,476.

Some suitable dried overlays, specifically the melamine-containing overlays are commercially available form Wilsonart International of Fletcher N.C.

Other Components of the Laminate

The laminate can comprise other components such as a phenolic core sheet, engineered wood sheet, such as particle board or fiber board or plywood. The phenolic core sheet typically comprises a plurality of phenolic resin-impregnated Kraft papers which are laminated together. Glues can also be included usually as seam sealants, for example, a hot wax-oil emulsion. Other suitable glues are made of acrylic polymer, polyvinylacetate, and polychloroprene and commercially available from Wilsonart International of Fletcher N.C.

Fluorourethane Composition:

The fluorourethane composition of the present disclosure is categorized based upon the use of diisocyanate or polyisocyanate (hereinafter the isocyanate reactant) as a reactant in the preparation as follows:

1) compounds prepared by reacting one or more diisocyanates (the isocyanate reactant), a fluorochemical compound containing one or more Zerewitinoff hydrogens (hereinafter the fluorochemical reactant) in an amount sufficient to react with 5% to 80% of the isocyanate groups, a compound of formula $(R_{10})$—$(R_2)_k$—YH (hereinafter the non-fluorinated reactant), and water; and
2) compounds prepared by reacting one or more polyisocyanates (the isocyanate reactant), a fluorochemical compound containing one or more Zerewitinoff hydrogens (fluorochemical reactant) in an amount sufficient to react with 5% to 33% of the isocyanate groups, a non-fluorinated reactant of formula $(R_{10})$—$(R_2)_k$—YH, and water.

The polyfluorourethane compositions used in the dried overlays of the present disclosure comprise both categories of the above polyfluorourethane compounds plus an additional group of compounds. This additional group comprises compounds prepared by reacting a polyisocyanate (the isocyanate reactant), a fluorochemical reactant in an amount sufficient to react with 5% to 80% of the isocyanate groups, a non-fluorinated reactant of formula $(R_{10})$—$(R_2)_k$—YH, and water.

The partial reaction of diisocyanates or polyisocyanates with water is referred to as "extension of the diisocyanate" and the reaction product is referred to as an "extended diisocyanate". Procedures for extending diisocyanates are well known in the art. As an example, Wagner in U.S. Pat. No. 3,124,605 describes methods for extending 1-methyl benzene-2,4-diisocyanate by reacting it with one half molar proportion of water to yield tri-N,N',N"-(3-isocyanato-4-methylphenyl)biuret.

A "Zerewitinoff hydrogen" is an active hydrogen which will react with a methyl magnesium halide (Grignard reagent) to liberate methane. The reaction is quantifiable by the method of Zerewitinoff et al., wherein an organic compound containing an active hydrogen such as —OH, —COOH, and the like is reacted with a methylmagnesium halide to liberate methane. Volumetric measurement of the methane permits a quantitative estimate of the active hydrogen content of the compound. Primary amines give 1 mol of methane when reacted in the cold, usually 2 mol when heated (Organic Chemistry by Paul Karrer, English translation published by Elsevier, 1938, p. 135). For purposes of this disclosure, it is assumed that a primary amine provides one active hydrogen as defined by Zerewitinoff et al. A Zerewitinoff hydrogen reacts with isocyanate groups to form urethanes.

The fluorourethane compositions of this disclosure are prepared from (1) an isocyanate reactant, (2) a fluorochemical reactant, (3) a non-fluorinated reactant, and (4) water. The fluorourethane compositions are prepared in a suitable solvent, converted to an aqueous emulsion, and mixed or applied on, typically coated, in an amount sufficient to yield a dried overlay containing from about 100 to about 20,000 μg/g fluorine. The dried overlays have increased soil resistance, increased oil repellency, and improved cleanability. The reactants and catalyst used to make the fluorourethane compositions, the preparation and emulsification processes, and the use and application of the fluorourethane compositions in connection with dried overlays are described sequentially below.

Any diisocyanate or polyisocyanate having three or more isocyanate groups can be used as the first or isocyanate reactant for the purposes of this disclosure. For example, one can use hexamethylene diisocyanate homopolymers having the formula:

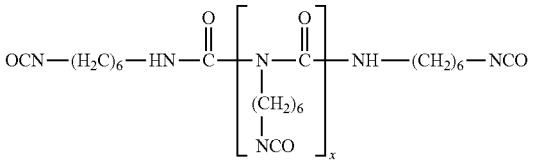

wherein x is an integer equal to or greater than 1, preferably between 1 and 8. Because of their commercial availability, mixtures of such hexamethylene diisocyanate homopolymers are preferred for purposes of this disclosure. Also of interest are hydrocarbon diisocyanate-derived isocyanurate trimers which can be represented by the formula:

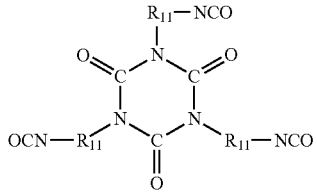

wherein $R_{11}$ is a divalent hydrocarbon group, typically aliphatic, alicyclic, aromatic, or arylaliphatic. For example, $R_{11}$ is hexamethylene, toluene, or cyclohexylene, preferably the former. Other polyisocyanates useful for the purposes of this disclosure are those obtained by reacting three mol of toluene diisocyanate with 1,1,1-tris-(hydroxymethyl)ethane or 1,1,1-tris-(hydroxymethyl)propane. The isocyanurate trimer of toluene diisocyanate and that of 3-isocyanatomethyl-3,4,4-trimethylcyclohexyl isocyanate are other examples of polyisocyanates useful for the purposes of this disclosure, as is methine-tris-(phenylisocyanate). Also useful for the purposes of this disclosure, is the polyisocyanate having the formula:

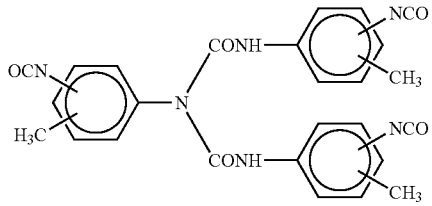

Some suitable commercially available diisocyanates are exemplified by DESMODUR H (1,6-hexamethylene diisocyanate, HMDI), DESMODUR W (bis[4-isocyanatocyclohexyl]methane, PICM), MONDUR TD (a mixture of toluene diisocyanate isomers, specifically 2,4-diisocyanato-1-methylbenzene and 1,3-diisocyanato-2-methylbenzene, TDI), MONDUR M (4,4'-diisocyanatodiphenylmethane, MDI), and isophorone diisocyanate (5-isocyanato-1-(isocyanatomethyl)-1,3,3-trimethyl-cyclohexane, IPDI) each available from Aldrich Chemical Co., Milwaukee Wis.

Some suitable preformed commercially available extended diisocyanates are exemplified by DESMODUR 3200 and DESMODUR N-100 (hexamethylene diisocyanate homopolymers) available from Bayer Corporation, Pittsburgh Pa., both presumably prepared by the process described in U.S. Pat. No. 3,124,605 to give mixtures of the mono-, bis-, tris-, tetra-, and higher order derivatives. Also suitable is DESMODUR 3300 (a hexamethylene derived isocyanurate trimer), and CYTHANE 3160 (a glycerol based isocyanate) available from American Cyanamid, Stamford Conn.

A wide variety of fluorochemical compounds can be used as the second or fluorochemical reactant so long as each fluorochemical compound contains at least two carbon atoms and each carbon atom contains at least two fluorine atoms. For example, the fluorochemical compound can be represented by the formula:

$$R_f—R_k—X—H$$

wherein $R_f$ is a monovalent aliphatic group containing at least two carbon atoms each of which contains at least two fluorine atoms;

R is a divalent organic radical;

k is 0 or 1; and

X is —O—, —S—, or —N($R_1$)—, wherein $R_1$ is H, an alkyl group containing 1 to 6 carbon atoms or a $R_f$—$R_k$-group.

In a more specific embodiment, the fluorochemical compound that contains a single functional group can be represented by the formula:

$$R_f—R_k—R_2—X—H$$

wherein $R_f$ and $R_k$ are as defined above;

R is a divalent radical: —$C_mH_{2m}SO$—, —$C_mH_{2m}SO_2$—, —$SO_2N(R_3)$—, or —$CON(R_3)$ in which m is 1 to 22 and $R_3$ is H or a divalent alkyl group of 1 to 6 carbon atoms;

$R_2$ is a divalent linear hydrocarbon radical, —$C_nH_{2n}$—, which is optionally end-capped with

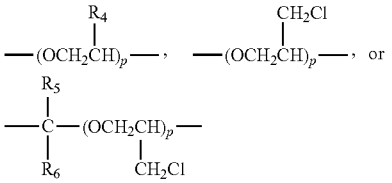

in which n is 0 to 12, p is 1 to 50;

$R_4$, $R_5$ and $R_6$ are the same or different and are H or an alkyl group containing 1 to 6 carbon atoms;

X is O, S, or N($R_7$) in which $R_7$ is H, an alkyl group containing 1 to 6 carbon atoms, or a $R_f$—$R_k$—$R_2$— group.

More particularly, $R_f$ is a fully-fluorinated straight or branched aliphatic radical of 3 to 20 carbon atoms which can be interrupted by oxygen atoms.

In a more typical embodiment, the fluorochemical compound can be represented by the formula:

$$R_f—(CH_2)_q—X—H$$

wherein

X is O, S, or N($R_7$) in which $R_7$ is H, an alkyl group containing 1 to 6 carbon atoms or a $R_f$—$R_k$—$R_2$— group, $R_f$ is a mixture of perfluoroalkyl groups, $CF_3CF_2(CF_2)_r$ in which r is 2 to 18; and q is 1, 2 or 3.

In a more particular embodiment, $R_f$ is a mixture of said perfluoroalkyl groups, $CF_3CF_2(CF_2)_r$; and r is 2, 4, 6, 8, 10, 12, 14, 16, and 18. In a most typical embodiment, r is predominantly 4, 6 and 8. In another typical embodiment, r is predominately 6 and 8. The former typical embodiment is more readily available commercially and is therefore less expensive, while the latter may provide improved properties.

Representative fluoroaliphatic alcohols that can be used for the purposes of this disclosure are:

$$C_sF_{(2s+1)}(CH_2)_t—OH,\ (CF_3)_2CFO(CF_2CF_2)_uCH_2CH_2OH,$$

$$C_sF_{(2s+1)}CON(R_8)—(CH_2)_t—OH,$$

$$C_sF_{(2s+1)}SO_2N(R_8)—(CH_2)_t—OH,\ \text{and}$$

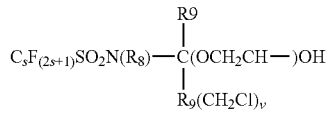

wherein s is 3 to 14; t is 1 to 12; u is 1 to 5; each of $R_8$ and $R_9$ is H or an alkyl group containing 1 to 6 carbon atoms.

In another embodiment, the fluorochemical compound can be represented by the formula:

$$H(CF_2CF_2)_wCH_2OH$$

wherein w is 1-10. The latter fluorochemical compound is prepared by reacting tetrafluoroethylene with methanol. Yet another such compound is 1,1,1,2,2,2-hexafluoro-isopropanol having the formula:

$$CF_3(CF_3)CHOH.$$

Suitable fluorinated alcohols of the second reactant with the structure $R_fCH_2CH_2OH$ wherein $R_f$ is a $C_2$-$C_{20}$ perfluorocarbon are exemplified by, but not limited to perfluoroalkyl ethanols available commercially as ZONYL BA and BA-N Fluorotelomer Intermediate from E. I. duPont de Nemours and Company, Wilmington Del. ZONYL BA and BA-N contain alpha-fluoro-omega-(2-hydroxyethyl)-poly(difluoromethylene) in the form of a mixture of the components of the homologous series of the formula $$F(CF_2CF_2)_n(CH_2CH_2)OH,$$

containing therein:

for n=2, BA contains 1%-2%, BA-N contains <1%
for n=3, BA contains 27%-34%, BA-N contains 3%-8%
for n=4, BA contains 29%-34%, BA-N contains 45%-50%
for n=5, BA contains 17%-21%, BA-N contains 28%-33%
for n=6, BA contains 6%-9%, BA-N contains 8%-13%
for n=7, BA contains 2%-5%, BA-N contains 1%-6%
for n=8, BA contains 1%-2%, BA-N contains 1%-6%

Suitable fluorinated thiols of the structure $R_fCH_2CH_2SH$ wherein $R_f$ is a $C_2$-$C_{20}$ perfluorocarbon of the second reactant are exemplified by LODYNE 924, commercially available from Ciba-Geigy, Ardsley N.Y. Suitable fluorinated sulfonamides of the structure $R_fSO_2N(CH_2CH_3)CH_2CH_2OH$ wherein $R_f$ is a $C_2$ to $C_{20}$ perfluoro group are exemplified by FLUORAD FC-10 available from 3M Company, Minneapolis Minn.

The third or nonfluorinated reactant used for preparing the polyfluoro compounds of the present disclosure and the polyurethane composition of the present disclosure comprises a non-fluorinated organic compound which contains a single functional group. Usually between about 1% to about 60% of the isocyanate groups of the polyisocyanate are reacted with at least one such non-fluorinated compound. For example, said non-fluorinated compound can be represented by the formula:

$$(R_{10})—(R_2)_k—YH$$

wherein $R_{10}$ is a $C_1$-$C_{18}$ alkyl group, a $C_1$-$C_{18}$ omega-alkenyl radical or a $C_1$-$C_{18}$ omega-alkenoyl;

$R_2$ is a divalent linear hydrocarbon radical, —$C_nH_{2n}$— optionally encapped by

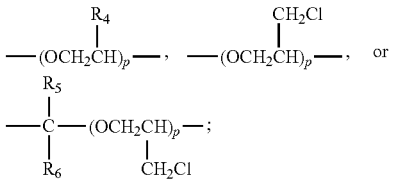

wherein $R_4$, $R_5$ and $R_6$ are the same or different and are H or an alkyl group of 1 to 6 carbon atoms;

n is 0 to 12, and p is 1 to 50;

Y is O, S, or $N(R_7)$ in which $R_7$ is H or an alkyl group containing 1 to 6 carbon atoms; and k is 0 or 1.

For example, the non-fluorinated compound can be an alkanol or a monoalkyl or monoalkenyl ether or ester of a polyoxyalkylene glycol. Particular examples of such compounds include stearyl alcohol, the monomethyl ether of polyoxyethylene glycol, the mono-allyl or -methallyl ether of polyoxyethylene glycol, and the mono-methacrylic or acrylic acid ester of polyoxyethylene glycol.

In one embodiment, the fluorourethane compositions of the disclosure are prepared by reacting: (1) at least one diisocyanate, or polyisocyanate or mixture of polyisocyanates which contains at least three isocyanate groups per molecule with (2) at least one fluorochemical compound which contains per molecule (a) a single functional group having one or more Zerewitinoff hydrogen atoms and (b) at least two carbon atoms each of which contains at least two fluorine atoms, and (3) at least one non-fluorinated reactant as described above. Thereafter the remaining isocyanate groups can be reacted with water to form one or more urea linkages or can be reacted completely with the previously described second and third reactants to form urea, carbamate, or thiocarbamate linkages.

Usually between about 40% and about 95% of the isocyanate groups will have been reacted before water is optionally reacted with the diisocyanate or polyisocyanate. In other words, the amount of water generally is sufficient to react with from about 5% to about 60% of the isocyanate groups in the diisocyanate or polyisocyanate. Typically, between about 60% and 95% of the isocyanate groups have been reacted before water is reacted with the diisocyanate or polyisocyanate, and most typically between about 80% and 90% of the isocyanate groups have been reacted prior to reaction of water. Thus, in a typical embodiment the amount of water is sufficient to react with about 5% to about 35% of the isocyanate groups, most typically between 10% and 20%.

The preparation of the fluorourethane composition is exemplified by reacting, in the presence of a catalyst, an alkyl-terminated polyalkylene glycol, a fluoroalcohol or fluorothiol, and optionally an alcohol, thiol, or amine, with a diisocyanate or extended diisocyanate in a suitable solvent such as methylisobutylketone solution. Suitable catalysts are well known to those skilled in the art. For instance the catalyst is a metal organic exemplified by dibutyl tin dilaurate or tin octoate, or a tertiary amine, exemplified by trialkylamines, pyridine, ethyl morpholine, 1,4-diazabicyclo[2.2.2]octane (DABCO, Aldrich Chemical Co., Milwaukee Wis.) or 1,8-diazabicyclo[5.4.0]undec-7-ene (DBU, Aldrich Chemical Co., Milwaukee Wis.). The reaction product is further reacted with water to give a polyurethane in methylisobutylketone. The polyurethane in methylisobutylketone is emulsified in water. In most cases emulsification occurs readily with mixing.

Emulsification is optionally facilitated by the use of homogenizing equipment and the use of anionic (e.g., alkyl sulfonates) or nonionic (e.g., alcohol ethoxylates or alkylphenol ethoxylates) surfactants chosen for compatibility with the water-dispersed coating composition. The methylisobutylketone solvent is removed under reduced pressure to leave an aqueous dispersion. This dispersion is then added to an existing water-dispersed coating composition and mixed thoroughly. The resulting modified water-dispersed coating composition is applied by standard means.

Suitable solvents for the reaction are exemplified by ketones such as methylisobutylketone, methyl amyl ketone, methyl ethyl ketone, esters such as ethyl acetate, and aromatic solvents such as toluene or xylene.

The emulsions of fluorourethane compositions are formed by sequentially reacting isocyanate, fluorinated, and non-fluorinated reactants, further extending the reaction product by reaction with water, and finally preparing an aqueous emulsion by adding water, optionally emulsification aids, and removing residual organic solvents.

Process of Applying Fluorourethane to the Dried Overlay

The aqueous emulsion of the fluorourethane can be first diluted by adding 20 parts to 500 parts of deionized water to 1 part of a fluorourethane emulsion. The diluted fluorourethane emulsion can then be coated onto a dried overlay. The coating step can be performed via, but not limited to, spraying or brushing of a diluted fluorourethane emulsion to the dried overlay or dipping the dried overlay into a diluted fluorourethane emulsion. The amount of fluorourethane coated onto a dried overlay can be calculated by measuring the weight gain of the dried overlay immediately following the coating process.

The fluorourethane treated dried overlay can then be dried. The drying temperature can be maintained between room temperature, about 25° C. to about 125° C., typically between about 80 and about 100° C.

The dried overlay, after treating with the fluorourethane composition to form a fluorourethane treated dried overlay, comprises fluorourethane predominantly present at the outer surface of the fluorourethane treated dried overlay. The fluorourethane can be present in the amount of about 50 to about 10,000 μg/g of fluorine and typically about 250 to about 1,000 μg/g of fluorine, based on the total weight of the fluorourethane treated dried overlay.

These and other considerations and parameters involved in the composition, production and decoration of laminate paper are well known to those of ordinary skill in the art as evidenced by many of the previously incorporated references.

Lamination Processes

The lamination processes can be high pressure or low pressure, but regardless of the lamination process the fluorourethane treated dried overlay is the outer layer of the laminated structure for easy cleanability of the laminate.

In a low pressure process, heated rollers are usually employed in a continuous process wherein the assembly is passed through the roller nip under compression at temperatures ranging from about 150 to about 200° C., more typically about 160 to about 180° C. and pressures between about 20 and about 40 bar.

In a high pressure process, heated platens are usually employed in a batch process wherein the assembly is placed between the platens under pressures of about 80 to about 100 bar and at temperatures ranging from about 130 to about 160° C., more typically about 140 to about 150° C.

Lamination times for the low pressure process are typically less about 1 minute, versus the high lamination process that may be several minutes.

The coating of fluorourethane composition to the dried overlay, drying, and lamination steps may be accomplished in a single process step.

The need for and choice of substrate and adhesive will depend on the desired end use of the laminate, as will be recognized by one of ordinary skill in the relevant art.

In this disclosure, the decorative surface of the laminates is modified with fluorourethane composition and the surface possesses characteristics of easy clean.

Industrial Application

The laminates of this disclosure are useful as flooring, furniture, countertops, artificial wood surface, and artificial stone surface.

The following Examples illustrate the present disclosure. All parts, percentages and proportions are by weight unless otherwise indicated.

EXAMPLES

Method 1-Leneta Oil Stain Cleanability Test

The test method described herein is a modification of ASTM 3450-00—Standard Test Method for Washability Properties of Interior Architectural Coatings, which is hereby used to test laminate samples. The test simulates cleanability of oily fingerprints or footprints.

Staining media were prepared using VASELINE NURSERY JELLY (Marietta Corporation, Cortland, N.Y.) and LENETA Carbon Black Dispersion in Mineral Oil (ST-1) (The Leneta Company, Mahwah, N.J.). The petroleum jelly was melted in a clean glass container for 30 minutes in an oven set at 70° C. Then the petroleum jelly was mixed with 5% of its weight of LENETA Carbon Black. For instance, 95 g of petroleum jelly were mixed with 5 g of LENETA Carbon Black to produce 100 g of staining media. The mixed staining media was cooled for several hours in a refrigerator at 4° C.

Cleaning media were prepared using a JOY ULTRA CONCENTRATED COUNTRY LEMON dishwashing liquid (The Procter & Gamble Company, Cincinnati, Ohio). Dishwashing liquid was mixed with deionized water at a ratio of 1 g of dishwashing liquid for every 99 g of water.

Each laminate sample was stained in the same manner. A staining template was prepared from a LENETA card by cutting out a 3" by 1" (7.6 cm×2.5 cm) strip from the interior of the card. The template was placed over a laminate sample to be stained. Staining media was spread over the area of the laminate sample under the template using a spatula. Excess stain was removed with a spatula. Stained laminate samples were allowed to set and dry for 60 minutes.

In preparation for cleaning, scrap MYLAR was used to gently scrape the excess dried stain from the stained section of the laminate sample. Similarly a c-folded clean paper towel was used to remove unset stain from the entire laminate, both the washed and unwashed sections. The laminate sample was then securely attached to a BYK-Gardner Abrasion tester (BYK-Gardner, Silver Spring, Md.), which used a one pound cleaning block. A piece of cheesecloth (VWR International, San Diego, Calif.) was attached to the cleaning block on the abrasion tester. The cheesecloth was folded and attached so that the contacting surface was 8 layers thick. 10 mL of cleaning solution prepared as specified above were applied to the contacting surface of the cheesecloth. The abrasion tester was run through 5 cycles (10 wipes) over a stained section of the laminate sample that is henceforth designated as stained and cleaned. Excess cleaning solution was rinsed away with deionized water for a few seconds and then allowed to dry for 2 hours or until completely dry by visible inspection. One section of each stained laminate sample card was cleaned in this manner.

Cleanability was determined by evaluating the stained and washed painted portion of the laminate sample in comparison to the unstained portion of the laminate sample. A HunterLab ULTRASCAN Pro colorimeter (Hunter Associates Laboratory, Inc, Reston, Va.) was used to measure L* of two designated sections of the laminate sample: stained and washed and unstained. The measurements were averaged to obtain a mean value for that section that is used to evaluate the cleanability as described below. The colorimeter used the aperture of either ½ or ¾ of an inch.

The cleanability was determined using Percentage of Stain Retention, which was calculated as follows, % Stain Retention=[(mean L*value of unstained section)−(mean L*value of stained and washed section)]/(mean L*value of unstained section)*100.

Method 2-Durable Cleanability Test

Wash durability of the laminate samples to surface cleaning was determined using the same scrubbing apparatus as described in Method 1. A laminate sample was pre-washed with the same cheese clothes as described in Method 1, which was soaked with 20 mL of a 1% aqueous JOY detergent solution. The test sample was removed after a predetermined number of scrub cycles, washed free of the JOY solution with running tap water, and air dried for 60 min. The pre-washed laminate sample was then evaluated using the Leneta Oil Stain Cleanability test, Test Method 1, described above.

Method 3-Contact Angle Measurement

Contact angles of laminate samples were made using a VCA Optima goniometer (AST Products, Inc., 9 Linnell Circle, Billerica, Mass. 01821) following the Sessile Drop Method, which is described by A. W. Adamson in The Physical Chemistry of Surfaces, Fifth Edition, Wiley & Sons, New York, N.Y., 1990. Additional information on the equipment and procedure for measuring contact angles is provided by R. H. Dettre et al. in "Wettability", Ed. by J. C. Berg, Marcel Dekker, New York, N.Y., 1993.

The advanced contact angles of both water and hexadecane at room temperature were measured. A drop of test liquid was first placed on the surface of a laminate sample. The image of the drop was captured with a CCD camera and then the tangent was precisely determined at the point of contact between the drop and the surface.

In general, higher oil (such as hexadecane) contact angles indicate that a surface has greater dirt and soil repellency, and easier surface cleanability.

Method 4-Measurement of Relative Abrasion Resistance

A Dual Taber® Abrader (Model 505, supplied by Teledyne Taber, 455 Bryant Street, North Tonawanda, N.Y.) with CS-10 Calibrase Abrader Wheels was used. A wheel pressure of 500 grams was applied. The surface of laminate samples was abraded when the abrasive wheels were turning on the laminate under pressure. The 85 degree gloss of laminate samples was measured before and after undergoing abrasion. A Haze-Gloss meter (BYK Gardner, Silver Spring, Md.) was used for the gloss measurement. The percentage of the gloss reduction is then calculated as a relative measurement of abrasion resistance.

Example 1

Preparation and Evaluation of Fluorourethane Treated LPL Laminates

Materials:

(1) Fluorourethane Composition

The fluorourethane composition is an aqueous solution of polyfluorourethane prepared as described in U.S. Pat. No. 5,827,919. This composition is supplied by E.I. du Pont Nemours & Co.

(2) Dried Melamine overlay

Melamine-formaldehyde partially cured film, #14 overlay supplied by Wilsonart International, PO Box 248, Creek Industrial Park, Fletcher, N.C. 28732 was used as the dried overlay. This overlay has a weight of about 120 g/M$^2$.

Preparation of Fluorourethane Composition Treated Dried Overlay

Two coating solutions were prepared by diluting 1 gram of fluorourethane composition with 50 grams and 100 grams of deionized water, respectively.

The above solutions were brush coated onto 6"×6" dried melamine overlay film samples. The samples were weighed to determine the fluorourethane composition content in the overlay. The coated overlay films, were dried by exposure first to room temperature (about 20 to about 25° C.) for 15 min and then in a forced air oven at 90° C. for 10 min. The amount of fluorourethane composition on the melamine overlay films was about 1 g/M$^2$ and about 0.5 g/M$^2$, respectively.

Preparation of Laminates

Stacked the following layers (from the top): plotter, metal sheet, a fluorourethane treated melamine overlay film (or a melamine dried overlay film without fluorourethane as Control), décor paper, a white paper, three Kraft papers, a white paper, a melamine overlay film, metal sheet, and plotter. Preheated the presser to 320° F. (160° C.). Placed stacked layers onto the presser. Compressed the sample under a pressure of 330 psi (22.8 bar) for 6 mins. Cooled down the laminate sample.

Evaluation of Laminates for Oil Repellency and Cleanability

The laminates samples with and without the surface modification with fluorourethane were evaluated for cleanability of Leneta oil stain, which simulates oily fingerprints or footprints, using the test Method 1. The samples were also analyzed for water and oil contact angle, using test Method 3.

TABLE 1

Contact Angle and Cleanability Results

| Laminate Sample | Contact Angle | | % Stain Retention |
|---|---|---|---|
| | Water | Hexadecane | |
| Control | 62 | 12 | 1.0 |
| 1 g/M$^2$ Fluorourethane | 65 | 66 | 0.0 |
| 0.5 g/M$^2$ Fluorourethane | 68 | 70 | 0.3 |

Evaluation of Laminates for Durable Cleanability

The laminate samples with and without the surface modification with fluorourethane were evaluated for durable cleanability, using Method #2.

The test laminates were first pre-washed with 1% Joy detergent solution, for 50 and 100 scrub cycles, using BYK-Gardner Abrasion Tester.

TABLE 2

Durable Oil Repellency and Cleanability Results

| Laminate Samples | Contact Angle - Oil | | | % Stain Retention | |
|---|---|---|---|---|---|
| | Initial | 50 cycle | 100 cycle | Initial | 100 cycles |
| Control | 16.0 | 0.0 | 0.0 | 1.0 | 0.8 |
| 0.5 g/M$^2$ fluorourethane | 70.0 | 34.5 | 32.0 | 0.3 | 0 |

Evaluation of Laminates for Improved Abrasion Resistance

The laminate samples with and without the surface modification with fluorourethane were evaluated for relative abrasion resistance, using Method #4.

The laminate samples was abraded with a CS-10 Calibrase Abrader Wheel under 500 grams of pressure for a total of 425 revolutions.

TABLE 3

Relative Abrasion Resistance Results

| Laminate Samples | Gloss @ 85 Degrees | | % Gloss Loss |
|---|---|---|---|
| | Initial | After Abrasion | |
| Control | 83.5 | 52.5 | 37.1 |
| 0.5 g/M$^2$ fluorourethane | 68 | 49.7 | 26.8 |

The description of illustrative and preferred embodiments of the present disclosure is not intended to limit the scope of the disclosure. Various modifications, alternative constructions and equivalents may be employed without departing from the true spirit and scope of the appended claims.

What is claimed is:

1. A process for preparing a laminate, comprising:

(a) providing a dried overlay and a base sheet wherein at least one of the dried overlay and the base sheet comprises a resin-impregnated, opaque, cellulose pulp-based sheet;

(b) applying a surface treatment to the dried overlay to form a treated overlay, wherein the surface treatment consists of a fluorourethane reaction product of (1) at least one diisocyanate, polyisocyanate, or mixture of polyisocyanates having at least three isocyanate groups per molecule, (2) at least one perfluoroalkyl compound having at least one Zerewitinoff hydrogen in an amount sufficient to react with at least 40% of the isocyanate groups in the diisocyanate or polyisocyanate, (3) at least one polyethylene glycol methyl ether in an amount sufficient to react with at least 30% of the isocyanate groups in the diisocyanate or polyisocyanate, and, (4) water in an amount sufficient to react with at least 5% of the isocyanate groups in the diisocyanate or polyisocyanate;

(c) drying the treated overlay from step (b); and (d) laminating the dried treated overlay from step (c) to the base sheet.

2. The process of claim 1 wherein the dried overlay comprises a resin-impregnated, opaque, cellulose pulp-based sheet.

3. The process of claim 1 wherein the dried overlay comprises a thermosetting resin selected from the group consisting of a polymer of diallyl phthalate, epoxide, urea formaldehyde, urea-acrylic acid ester copolyester, melamine formaldehyde, melamine phenol formaldehyde, dicyandiamide-formaldehyde, urethane, curable acrylic, unsaturated polyester and phenol formaldehyde and mixtures thereof.

4. The process of claim 3 wherein the dried overlay further comprises a binding material selected from the group consisting of microcrystalline cellulose, carboxyl methyl cellulose, sodium alginate and mixtures thereof.

5. The process of claim 3 wherein the dried overlay further comprises mineral particles selected from the group consisting of aluminum oxide, silicon oxide and mixtures thereof.

6. The process of claim 1 wherein the base sheet comprises a resin-impregnated, opaque, cellulose pulp-based sheet.

7. The process of claim 6 wherein the resin is a thermosetting resin selected from the group consisting of a polymer of diallyl phthalate, epoxide, urea formaldehyde, urea-acrylic acid ester copolyester, melamine formaldehyde, melamine phenol formaldehyde, dicyandiamide-formaldehyde, urethane, curable acrylic, unsaturated polyester and phenol formaldehyde and mixtures thereof.

8. The process of claim 7 wherein the dried overlay further comprises a resin and the base sheet is a resin-impregnated, opaque, cellulose pulp-based sheet, the resin of the dried overlay and the base sheet are the same.

9. The process of claim 1 further comprising forming the dried overlay by forming a water-dispersed overlay comprising a suspension of a thermosetting resin and a binding material in an aqueous medium and drying the suspension by removing water from the suspension to form the dried overlay.

10. The process of claim 1 wherein the surface treatment is substantially free of a thermosetting resin selected from the group consisting of a polymer of diallyl phthalate, epoxide, urea formaldehyde, urea-acrylic acid ester copolyester, melamine formaldehyde, melamine phenol formaldehyde, dicyandiamide-formaldehyde, urethane, curable acrylic, unsaturated polyester and phenol formaldehyde and mixtures thereof.

* * * * *